United States Patent [19]

Rothfjell

[11] Patent Number: 4,581,482

[45] Date of Patent: Apr. 8, 1986

[54] METHOD AND DEVICE FOR SIGNATURE VERIFICATION

[75] Inventor: Rolf E. Rothfjell, Kalix, Sweden

[73] Assignee: Esselte Security Systems AB, Stockholm, Sweden

[21] Appl. No.: 625,526

[22] Filed: Jun. 28, 1984

[30] Foreign Application Priority Data

Jul. 1, 1983 [SE] Sweden ..... 8303799

[51] Int. Cl.[4] ..... G08C 21/00

[52] U.S. Cl. ..... 128/18; 235/472; 382/3

[58] Field of Search ..... 178/18, 19, 20; 235/462, 472; 382/3, 13

[56] References Cited

U.S. PATENT DOCUMENTS 3,127,588 3/1964 Harmon ..... 178/18

*Primary Examiner*—Stafford D. Schreyer

*Attorney, Agent, or Firm*—Silverman, Cass & Singer, Ltd.

[57] ABSTRACT

The invention relates to a method of signature verification and is characterized in that an electric pulse train individual for each person in question is generated in that said person is allowed to move a so-called reading pencil over a patterned background comprising dark and light portions, and that such a pulse train generated on a certain occasion is compared by means of a computer or the like to pulse trains generated earlier by said person and stored in said computer.

According to a preferred embodiment, said patterned background is a line code (1) consisting of parallel dark lines (11) separated by lighter lines or areas (10).

12 Claims, 3 Drawing Figures

METHOD AND DEVICE FOR SIGNATURE VERIFICATION

Figure 1:
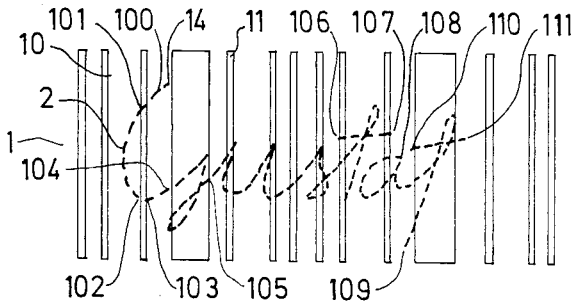

This invention relates to a method of verifying a signature and to a device for carrying out the method. It has become a problem of increasing difficulty to correctly identify persons and the signatures of persons.

One special problem in this respect is to identify a person for a system, for example a computer system, i.e. in cases when no other person is available to prove the necessary identification.

One example of such cases are purchases with credit cards where an information stored on the card, for example a code, is compared to a code actuated by the user by means of a keyboard. When the code proves correct, the person using the card is assumed having stated the code, and the purchase is effected. A code proving incorrect is refused. Such cards are used for example in automatic withdrawal of money and for purchase of gasoline.

This system described does not identify the proper person, but merely ascertains the correctness of the code stated.

Similar systems are used as key codes for making processing programs and information stored in computer memories accessible only to certain authorized persons who had to learn a certain alphanumerical code, which upon being stated, for example by a computer terminal, opens certain parts of stored information or programs.

The utilization of computer terminals in the homes for carrying out various pursuits, such as money transactions, so-called "home-banking", is one example of a situation where the identification of the person acting is extremely essential. In this case, as in other ones, it is not sufficient that the proper person has access to a code, because this can be written down or be disclosed in some other way to unauthorized persons.

A vast number of similar examples exist, one of which is identification of a person in a bank. For performing bank commissions, it is desirable that everybody at any time can be identified with high safety.

The signature of a person, with few exemptions, is a denotation very characteristic for a person and is used to a great extent in connection with documents of value, payment orders, contracts etc.

The present invention provides a safe method of identifying a person automatically, i.e. without requiring another person to perform an identity control.

The invention, thus, relates to a method of signature verification and is characterized in that an electric pulse train individual for each person in question is generated by said person being allowed to move a so-called reading pencil over a patterned background comprising dark and light portions, and that such a pulse train generated at a certain occasion is compared by means of a computer or the like to pulse trains generated earlier by the same person and stored in said computer or the like.

The invention further relates to a device for carrying out the signature verification of the kind and with the main characterizing features as defined in the attached claim 8.

Signature in this connection is to be understood not only as what normally is called a name signature, but it refers to any written signature, symbol or the like.

The invention, thus, is based on the idea of generating an electric pulse train individual for each person by means of a patterned background and a reading pencil, and to compare such a pulse train generated on a certain occasion to pulse trains generated earlier and stored.

The invention, thus, more precisely relates to a method, in which a person is to move an object, for example a reading pencil, so that the pencil point describes a plane figure, for example a signature. In a first step, a patterned background, preferably a line code, is used so that the person with the reading pencil writes his or her signature over the line code, whereby a first electric pulse train is generated when the pencil point is moved over alternatingly dark and light areas of the background. Preferably a large number of signatures are carried out, and the pulse trains are stored in a memory associated with a computer. In a second step, when the signature is to be verified, the person in question writes his or her signature with a reading pencil over a patterned background, which is identical with the first-mentioned background, whereby a second pulse train generated by the reading pencil is fed into the computer. In a third step the computer carries out a comparison between at least a portion of said first pulse train and said second pulse train. When the comparison proves that the pulse trains or portions thereof are identical to a predetermined degree, it can be assumed verified that the last written signature is written by the same person who had written the firstmentioned signature.

The pattern, as mentioned, preferably consists of a line code, which comprises parallel dark lines separated by lighter lines or areas.

According to a preferred embodiment, the line code contains information specific for the person in question, for example the birthday registration number of the person.

The specific information is coded in the code, after which the line code is arranged. Therefore, when a reading pencil is moved along a straight line over the entire code in a direction perpendicular to the lines of the line code, the birthday registration number of the person, for example, can be shown on a display or printer, in order to facilitate in certain cases the production of information about the person in question.

As mentioned above, the entire first pulse train, i.e. the pulse train stored in the computer memory and, respectively, portions thereof can be compared to the entire second pulse train and, respectively, portions thereof, i.e. the pulse train generated by the person when the verification of the signature is to take place.

A very high safety level, namely, very probably can be obtained even when only a portion of the pulse trains is compared, and at the same time a high acceptance level can be maintained when only a portion of the pulse trains is compared. This has to do with the fact, that a person writes his or her signature differently, a.o. depending on the state of mind the person is in. Mostly, however, a certain number of sections of the signature are very much alike each other and substantially independent of the state of mind and the influence by external factors.

According to a preferred embodiment, therefore, in said first step a great number of signatures written by the same person are stored in a computer, which thereafter compares these signatures and selects portions of these pulse trains which to a predetermined degree are similar to each other. The computer then stores the selected portions and in said third step compares the selected portions to corresponding portions of the pulse train generated when the signature verification was taking place.

In order to facilitate the pulse trains to become substantially similar when the pencil is moved in substantially the same manner over the line code, according to a preferred embodiment the pattern is in a predetermined position when the person is to start writing the signature. This position can be marked by a point or the like, but there must not necessarily be such a marking. In the lastmentioned case, the person in question shall know where to place the reading pencil at the start of the signature writing. Such a starting point, for example, can be one end of a line in the line code.

A line code is a one-dimensional phenomenon in the sense that the information is located in only one coordinate direction. A signature, however, normally is two-dimensional, but the signature cannot be reconstructed only by guidance of a pulse train, which is generated in that a reading pencil has been moved over a line code. The pulse train indicates only the periods when the pencil had been moved over dark and, respectively, light lines. It is, therefore, not possible, either, to read from the pulse train the speed, at which the pencil is moved over the line code in different phases of the signature writing.

It is possible, however, to record and use for verification the total time for performing the pulse train, i.e. the duration of the pulse train, and also the duration of single pulses or the duration of different partial pulse trains.

For this reason, the appearance of the signature in reality is not of interest, but only the pulse train generated by the signature with a certain line code.

In the analysis of such a pulse train it is the number of parameters, as also the combination of different parameters, which yield the accuracy of which the signature must be written in relation to pulse trains stored in the computer for acceptance to be obtained, i.e. for verification.

It may be pointed out that a signature of the type name signature often is written in different movements and the pencil is lifted between these different movements. When a name signature is written in this manner, a plurality of partial pulse trains will be generated.

For a comparison between different pulse trains, thus, the number of pulse trains, the absolute length of each pulse train, or the length in relation to the total length of all pulse trains, the number of pulses in each pulse train and the absolute length of each pulse or its length relative to the length of the pulse train, in which the pulse is comprised, can be utilized.

It depends on the field of application, the desired level of acceptance etc., which of the aforesaid methods, or combinations thereof, are to be used. The person skilled in the art, therefore, is free within the scope of the invention to select the parameters or parameter combinations suitable for the purpose intended.

According to a preferred embodiment, however, the length of one or several pulses in a pulse train in relation to the length of the pulse train or a portion thereof are characteristic values of a comparison between pulse trains. These values can be read easily and have good reproductivity. The same applies to another preferred embodiment, according to which the duration of one or several pulses in relation to the duration of the entire pulse train or a portion thereof are characteristic values.

Figure 2:
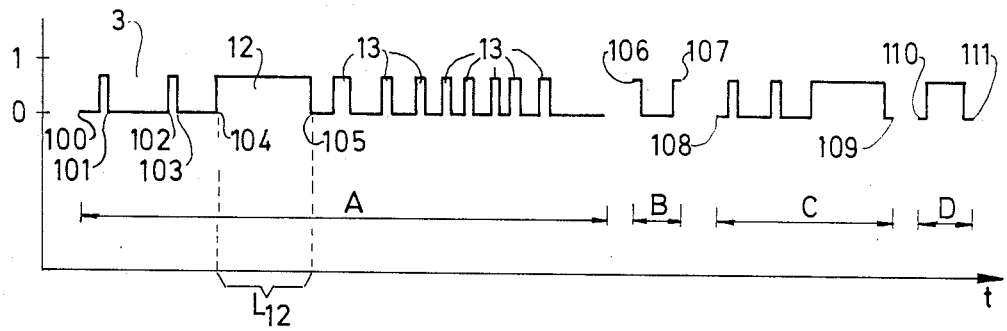
Figure 3:
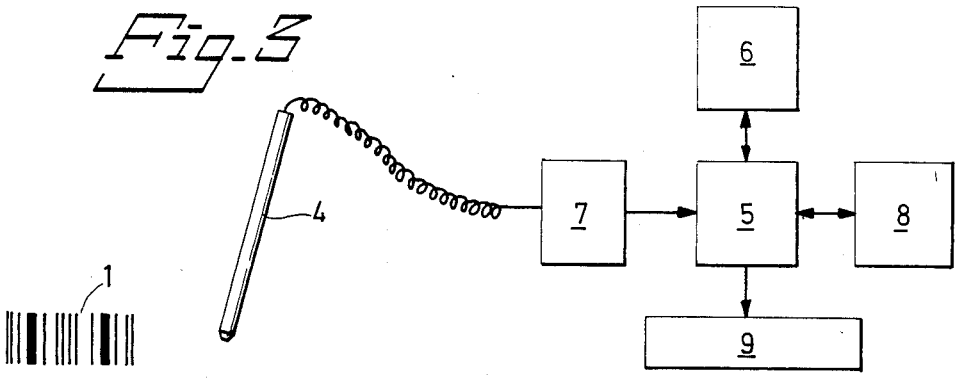

The invention is described in the following with reference to the accompanying drawing showing embodiments of the invention, where FIG. 1 shows a patterned support in the form of a schematic line code, over which the path of a reading pencil is indicated by dashed lines, FIG. 2 shows schematically the pulse train generated when a reading pencil is moved as shown in FIG. 1, and FIG. 3 is a schematic block diagram of a device according to the invention.

In FIG. 1 a line code 1 is shown schematically. For the sake of clearness, the lines have not been coloured dark. The name "Gustaf" is written over the line code by means of a reading pencil which, of course, does not leave behind any visible writing, but the dashed line 2 shows how a reading pencil has been moved over the line code.

The device, thus, comprises a patterned support, which preferably contains a line code 1. The support can be a screen, a wear-resistant material, for example a glass plate when the support is to be used many times, or a document of paper, for example a cheque form etc. The pattern, of course, can comprise patterns or figures other than a line code.

FIG. 3 is a schematic block diagram of a device according to the invention. The device comprises a patterned support 1 and a reading pencil 4, which is of the known type having adjacent to its point a light-emitting element, usually a light emitting diode, and a light sensitive element, usually a phototransistor. The light emitting diode emits light to the support. When the pencil is being moved over light and, respectively, dark areas, light is reflected and, respectively, not reflected. Reflected light is scanned by the phototransistor, which hereby generates an electric pulse train varying with the reflected light.

The device further comprises a computer 5 or corresponding means with an associated memory 6. The reading pencil is connected to a feed unit 7 capable to feed a pulse train generated by the reading pencil into the memory 6 of the computer 5. As stated above, in a first step a large number of pulse trains of the first type are fed into the computer memory 6. The computer 5 is programmed in known manner to compare such first pulse trains according to different criteria to each other and thereby to select certain characteristic portions or sections of the pulse trains and thereafter to store such selected portions or sections in a second memory 8. This memory 8 also can contain information on the birthday registration number, account number, on parts of data records a certain person is authorized to have access to, or other information.

In the verification of a signature, thus, the person in question again writes his or her signature by means of the reading pencil 4 over the line code 1. A pulse train of said second type is hereby stored in the computer memory 6. The computer 5 is suitably programmed so as to compare at least a portion of a first pulse train stored in the second computer memory 8 to at least a corresponding portion of the second pulse train stored in the memory 6. When the comparison proves that the pulse trains or portions thereof are similar to each other to a predetermined degree, the computer verifies that the signature written last has been written by the same person who has written the signature, which generated pulse trains of said first type. For this purpose, a display 9 or corresponding means can be connected to the computer 5. The computer, however, can be connected to additional computers, which are informed that verification has taken place, in that the computer 5 emits a signal to such computers. The signal can contain, for example, a person's birthday registration number, account numbers connected to the person together with a code indicating that the person, i.e. the operator, has been identified.

The computer 5, the associated memories 6,8 and the programming of a computer for obtaining the aforesaid result are well-known in the art and, therefore, not described here in detail.

FIG. 2 shows schematically a pulse train 3 as a result of that a reading pencil has been moved over the line code in FIG. 1 along the dashed line 2. The pulse train 3 is illustrated in a level-time diagram, where level "0" corresponds to a light area 10 and level "1" corresponds to a dark line 11. In order to facilitate the following of the pulse train 3, in FIG. 1 positions 100-111 are indicated which correspond to positions 110-111 in FIG. 2.

It is apparent, thus, that a pulse train 3 is generated which can be regarded individual for each person, or in any case as individual as a name signature. At said comparison, for example, one or several characteristic portions of the pulse train are compared, for example the occurrence of only one long pulse 12 on "level 1" followed by eight short pulses 13 on "level 1", or some other pulse sequence, which at the writing of a great number of signatures had proved to be repeated with a predetermined degree of identity.

The pulse length $L_{12}$ as well as the length of other pulses in relation to the total length of certain pulses or portions of the pulse train can be utilized.

As appears from FIG. 2, the pulse train consists of four partial pulse trains A,B,C and D. Between these portions the reading pencil is lifted at the writing of the name "Gustaf". The number of portions also can be utilized for said comparison, in combination with some other parameter.

From the pulse train per se does not appear the duration of each pulse. By measuring the time, the duration of pulses or portions of pulses relative to the whole pulse train or portions thereof can be utilized as a parameter.

It is obvious, thus, that for the expert a plurality of criteria exist which can be utilized for classifying and identifying such pulse trains. The invention in its widest scope is not restricted to any principle, according to which identification takes place.

According to a further embodiment of the invention, the line code 1, as mentioned, is designed so as to contain information, which is specific for the person in question, for example the birthdate registration number of the person coded in the code, according to which the line code is arranged.

In this case the verification of the signature can commence with moving the reading pencil over the line code perpendicularly to the lines, whereby the pulse train generated thereby is fed into the computer 5. The computer decodes the pulse train so that, for example, the person's birthdate registration number appears. The computer 5, therefore, searches in its memory 8 for the characteristics in the pulse train of said first type of person in question. When the person thereafter writes his or her signature, said comparison is carried out. According to this embodiment, thus, the computer must not compare a pulse train of said second type to all pulse trains of said first type stored in its memory. A further gain is that every person utilizes a specific line code, because the birthdate registration number of the person is contained in the line code, thereby increasing the safety substantially.

It is obvious that the pattern or line code can be varied in many ways.

It is preferred, as mentioned, that a person starts writing his or her signature in the same place every time. For this purpose, a starting point 14 can be marked in the line code. This starting point, however, as mentioned above must not necessarily be marked.

According to a further embodiment, at verification, i.e. when said second pulse train is to be generated, the line code, over which the person shall write the signature with a reading pencil, can be projected on a glass plate, screen or the like. The line code can also be enlarged by the projection, because it can be preferable at times to write the signature on a line code of greater dimensions.

The degree of enlargement can be varied from one person to another. A certain person, thus, can have chosen to write the signature on a code, which is enlarged or reduced to a certain extent. The degree of enlargement hereby can be comprised as a passive parameter.

It is apparent, thus, that the present invention implies a safe and inexpensive way of verifying a person's signature and identity. The inexpensiveness is due to the fact that the most obvious fields of application, such as bank transactions, authorization controls at computer systems etc. have already computers at their disposal.

It is also apparent that the invention can be varied in many ways. The invention, therefore, must not be regarded restricted to the embodiments described above, but can be varied within the scope defined in the attached claims.

I claim:

1. A method of signature verification comprising:

A. generating a plurality of first electric pulse trains individual to a signature of a given person by said person repeatedly moving a reading device over a patterned background comprising dark and light portions, in the configuration of said signature;

B. comparing said first pulse trains and selecting similar ones of said first pulse trains;

C. storing at least one of said selected pulse trains in a computer; and thereafter D. generating a second electric pulse train by said person in the manner of step A; and E. comparing the second pulse train to one or more of said stored, selected pulse trains for said verification.

2. A method as defined in claim 1 wherein said patterned background is a line code consisting of parallel dark lines separated by lighter lines or areas, and said reading device comprises an optical stylus for reading said line code.

3. A method as defined in claim 2, wherein the line code contains information specific for the person in question, for example the person's birthdate registration number coded in the code, according to which the line code is arranged.

4. A method as defined in claim 1 wherein there is a predetermined position, at which the person shall commence writing the signature.

5. A method as defined in claim 1 wherein the pulse trains include a length of one or several pulses in relation to the length of the pulse train or a portion of the pulse train length are characteristic values of said comparison.

6. A method as defined in claim 1 wherein a duration of one or several pulses in relation to a duration of the entire pulse train or a portion thereof are characteristic values of said comparison.

7. A method of signature verification comprising:

A. generating a plurality of first electric pulse trains individual to a signature of a given person by said person repeatedly moving a reading device over a patterned background comprising dark and light portions, in the configuration of said signature;

B. comparing said first pulse trains and selecting similar ones of said first pulse trains;

C. partitioning said selected pulse trains to obtain select portions thereof;

D. storing at least one of said select portions in a computer; and thereafter

E. generating a second electric pulse train by said person in the manner of step A;

F. partitioning said second pulse train to obtain at least one select second portion corresponding to said select portion; and G. comparing said select second portion to said select portion for said verification.

8. A device for signature verification, with which a person is to move an object, for example a pencil, so that the point thereof describes a plane figure, for example a name signature, characterized in that it comprises a support (1), which is patterned, preferably patterned with a so-called line code, a reading pencil (4), which in a manner known per se is capable to emit an electric pulse train (3) when the pencil point is moved over alternatingly dark and light areas of the support, and a computer (5) with associated memory (6,8), which reading pencil (4) is capable to emit a pulse train (3) generated by the reading pencil (4) in that a person with the reading pencil writes his or her signature over the pattern (1), to the memory (6,8) of the computer (5), which computer (5) is capable to compare at least a portion of such a first pulse train stored in its memory (6,8) with at least a corresponding portion of a second pulse train, which is generated in that the person in question has written his or her signature by a reading pencil (4) over a pattern (1), which is identical with said firstmentioned pattern, and that said computer (5) is capable, when the comparison proves that the pulse trains (3) or portions thereof are to a predetermined degree identical, to indicate that it is regarded verified, that the signature written last has been written by the same person who has written the firstmentioned signature.

9. A device as defined in claim 8, characterized in that said computer (5) is capable to store pulse trains corresponding to a great number of signatures written by the same person and to compare these and thereby to select portions of pulse trains fed-in which to a predetermined degree are identical, and that the computer (5) is capable to store such selected portions and to compare the selected portions to corresponding portions of said second pulse train.

10. A device as defined in claim 8, characterized in that said support consists of a plane surface, to which a line code (1) consisting of parallel dark lines separated by lighter lines is applied.

11. A device as defined in claim 8, characterized in that the line code (1) is designed to contain information specific for the person in question, for example a birthdate registration number of the person coded in the code, according to which the line code (1) is arranged.

12. A device as defined in claim 8, characterized in that the support is provided with a starting point (14), which marks a point where a person shall commence writing his or her signature.

* * * * *